US007397193B2

(12) United States Patent
Kraus

(10) Patent No.: US 7,397,193 B2
(45) Date of Patent: Jul. 8, 2008

(54) DISCHARGE LIGHT SOURCE WITH ELECTRON BEAM EXCITATION

(75) Inventor: Albrecht Kraus, Kerkrade (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 392 days.

(21) Appl. No.: 10/506,273

(22) PCT Filed: Feb. 26, 2003

(86) PCT No.: PCT/IB03/00717

§ 371 (c)(1),
(2), (4) Date: Aug. 31, 2004

(87) PCT Pub. No.: WO03/075313

PCT Pub. Date: Sep. 12, 2003

(65) Prior Publication Data

US 2005/0117621 A1 Jun. 2, 2005

(30) Foreign Application Priority Data

Mar. 5, 2002 (DE) ..... 102 09 642

(51) Int. Cl.
*H01J 17/20* (2006.01)

(52) U.S. Cl. ..... 313/637; 313/591

(58) Field of Classification Search ..... 313/484, 313/485, 591, 607, 637, 234
See application file for complete search history.

(56) References Cited

U.S. PATENT DOCUMENTS

| | | | | |
|---|---|---|---|---|
| 1,659,636 | A * | 2/1928 | Null | 313/2.1 |
| 4,994,709 | A * | 2/1991 | Green et al. | 313/310 |
| 6,052,401 | A | 4/2000 | Wieser et al. | 372/74 |
| 6,857,923 | B2 * | 2/2005 | Yamada et al. | 445/24 |

* cited by examiner

*Primary Examiner*—Vip Patel

(57) ABSTRACT

A light source has a discharge vessel which is filled with a filling gas, and an electron beam source which is arranged in vacuum or in a region of low pressure. The electron beam source generates electrons which are propelled through an entry foil into the discharge vessel. An electric field may be generated inside the discharge vessel.

22 Claims, 2 Drawing Sheets

DISCHARGE LIGHT SOURCE WITH ELECTRON BEAM EXCITATION

Figure 1:
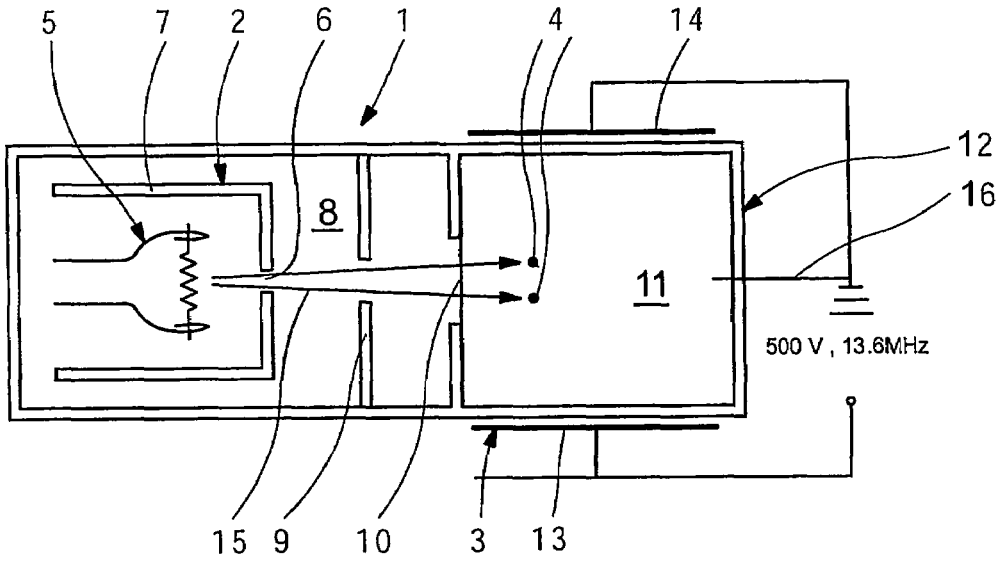

The invention relates to a light source with a discharge vessel which is filled with a filling gas, and with an electron beam source arranged in vacuum or in a region of low pressure, which source generates electrons and propels them through an inlet foil into the discharge vessel.

Such a light source is known from U.S. Pat. No. 6,052,401. A rare gas is present in the discharge vessel. The electrons propelled into the vessel, also denoted primary electrons hereinafter, have a high kinetic energy and knock second electrons, also denoted secondary electrons hereinafter, present in outer shells of atoms away from the atoms. A primary electron introduced through the foil is capable of knocking secondary electrons from several atoms in succession in cascade fashion before losing its kinetic energy. The rare gas ions change into excited rare gas molecules, denoted excited state dimers or excimers for short, after several reaction steps. Such an excimer decomposes spontaneously and emits ultraviolet or UV radiation during this. Atoms of the gas are thus ionized by the introduced electrons, the ionization energy being finally converted into a UV photon. The efficacy of the electron beam source and of the light source is low.

The invention accordingly has for its object to provide an improved light source. In particular, the efficacy, i.e. the ratio of generated light to the power consumed, is to be improved.

According to the invention, an electric field can be generated inside the discharge vessel. Further processes develop inside the discharge vessel in addition to the process described above.

Secondary electrons are free electrons which have elastic collisions with one another and with the atoms of the filling gas. An energy balance of the electrons adjusts itself automatically in a very short time, which balance can be described by approximation by means of a Maxwell velocity distribution. The electron temperature $T_e$ here denotes the average kinetic energy of the electrons. A proportion of these free electrons has a kinetic energy which is sufficient for exciting atoms. Free electrons collide with electrons present in atom shells and transfer their kinetic energy, which they build up again subsequently through acceleration in the electric field. The electrons of the atoms absorb the energy and jump to an outer shell with a higher energy level. The shells are numbered consecutively starting in the center towards the outside. When an electron drops back to a lower energy level, energy is released in the form of radiation.

The injected electrons thus substantially initiate two physically different processes. On the one hand atoms are ionized, while on the other hand atoms are excited. The two processes require different quantities of energy. The electron temperature $T_e$ adjusts itself independently by means of the ionization. This temperature, however, is not an optimum for an efficient excitation of the atoms. Since the ionization requires a substantially higher energy than the excitation, the electron temperature is too high for an efficient excitation, and thus for an efficient generation of UV radiation. When the gas inside the discharge vessel, also denoted gas volume hereinafter, is exposed to the electric field, the electron temperature $T_e$ required for an efficient excitation may be freely chosen across the electric field. The electron beam serves essentially for generating the charge carriers in the gas volume and the preliminary configuration of an ionized gas, also denoted plasma hereinafter. The application of an electric field across the gas volume additionally induces a glow discharge. Light is emitted in principle because of the electric field. The power for generating the electron beam is reduced.

In a simple embodiment, the discharge vessel comprises electrically conductive electrodes. The electrodes generate the electric field in a capacitive manner. Electrodes arranged inside the discharge vessel may be operated with an AC or a DC voltage, those arranged outside the discharge vessel are operated with an AC voltage.

Advantageously, the electrodes comprise a dielectric. A frequency of the AC voltage may be reduced because of the dielectric.

In a simple embodiment, the discharge vessel comprises a coil. The coil generates an inductive AC field.

Advantageously, the discharge vessel comprises a microwave resonator. The microwave resonator generates a rotational field which causes electrons to rotate along circular paths.

Advantageously, the electron beam source comprises a field emitter. A field emitter array, a surface emitter array, or an array of nanotubes may be used for this. Very small constructional units can be achieved thereby. The arrays have a grid-type structure or a surface comprising pyramids or tentacles, from whose tips electrons are freed.

A conventional electron gun as used in TV tubes may also be used for generating the electron beam. The electron gun must be operated in high vacuum so as to avoid a destruction of the cathode by ionized residual gases.

Advantageously, the filling gas comprises at least one of the rare gases He, Ne, Ar, Kr, Xe. Being ionizable, rare gases serve to generate light in the UV range and serve as a buffer gas for generating charge carriers.

Advantageously, the filling gas comprises at least one of the gases $H_2$, $N_2$, $O_2$, $F_2$, $Cl_2$.

Advantageously, the filling gas comprises at least one of the following elements which are wholly or partly evaporated under operational conditions: Br, I, S, Se, Te, Po, P, As, Sb, Zn, Cd, Hg, In, Tl, Li, Na, K, Rb, Cs, Sr, and Ba in atomic or molecular form. Suitable filling gases are in particular pure rare gases or mixtures of a rare gas and a light-emitting gas. If pure rare gases are used, a very efficient way of generating, for example, UV radiation is by means of excimer radiation. If a mixture of light-emitting gas and rare gas is used, for example argon/mercury, a lamp with a high brightness is obtained. Alternative light-emitting gases, however, are molecular radiators which may be chemically highly aggressive because of the absence of inner electrodes. The gases emit visible light, UV, or infrared radiation. A huge advantage arises from the possibility that the states excited by the electron beam can be utilized for further excitation in the electric field. For example, the ions generated in the electron beam may be utilized for further excitation in the electric field. There is a plurality of ions, for example $Ba^+$, $Rb^+$, or $Cs^+$, which have strong transitions in the visible wavelength range. The same principle is operative in the excitation from long-life excited states which are generated in large numbers by the electron beam. A simple example is the neon gas mentioned above, whose first excited level in the third shell, also denoted 3s level hereinafter, is caused to be occupied by means of the electron beam. Starting from this level, which has a very long effective life because the decay into the base state is strongly hampered by reabsorption in the dense neon gas, a plurality of higher levels may be excited by the electric field, which levels will subsequently emit radiation in the visible wavelength range. A possibility of having the 3s level of neon occupied to an even greater extent is offered in a mixture of helium and neon. Starting from the helium ion generated in large numbers by the electron beam, it is possible here to occupy finally the 3s state of the neon via a series of processes. A system based on the electron beam and the applied field may be readily arranged such that only a small portion of the electrical energy supplied on the outer side is used for the electron beam, for example 10%, whereas the major portion of the energy, 90% in this case, is utilized for the efficient radiation generation in the electric field.

Advantageously, the discharge vessel comprises a phosphor which converts said UV radiation into visible light.

Advantageously, the discharge vessel comprises two diametrically opposed mirrors. The mirrors form optical resonance bodies with parallel or slightly concave surfaces and serve to generate coherent light for a laser.

Advantageously, the electron beam source is operated in a pulsatory manner. The pulsatory operation serves to generate coherent light for a laser.

Figure 2:
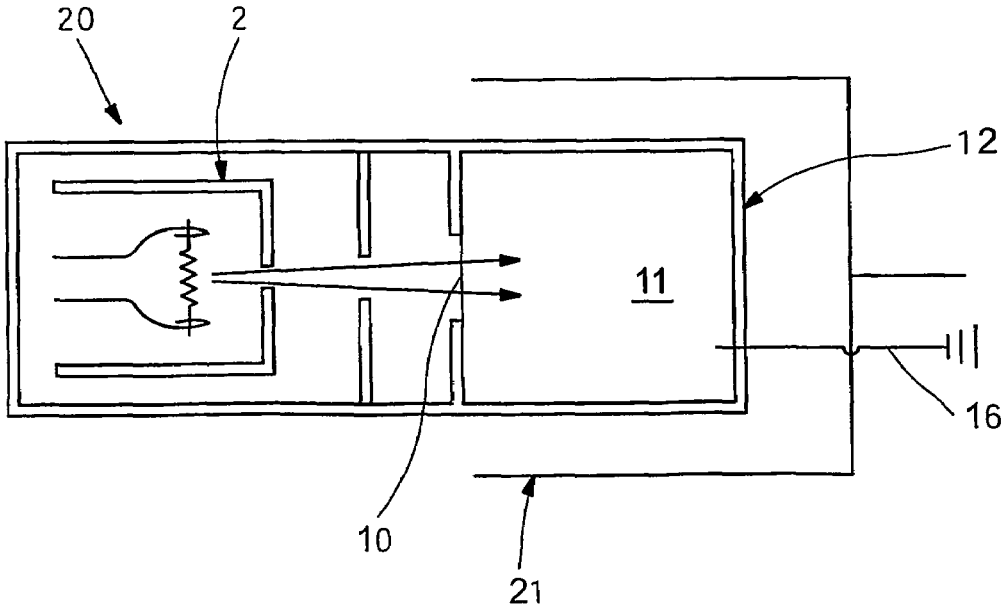
Figure 3:
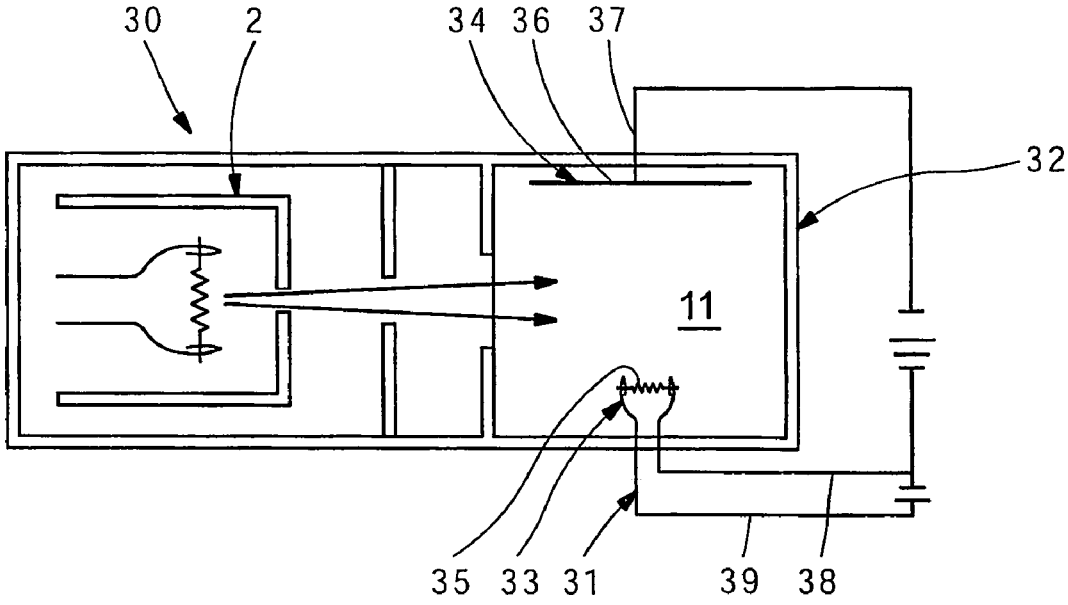

An embodiment will be explained in more detail below for better understanding with reference to the drawing, in which:

FIG. 1 shows a light source with external electrodes in cross-sectional view, FIG. 2 shows a second light source with a microwave resonator in cross-sectional view, and FIG. 3 shows a third light source with internal electrodes in cross-sectional view.

FIG. 1 shows a light source 1, also denoted gas discharge lamp hereinafter, with an electron beam source 2 and an electrode arrangement 3 for generating a glow discharge. Electrons 4 are emitted from a heated cathode 5 and pass through a hole 6 of a Wehnelt cylinder 7 into the acceleration range 8. Here the electrons 4 are accelerated towards a ring anode 9 which they pass with an energy of 20 keV. Subsequently, they pass through a 300 nm thin entry window 10 of SiN into a gas space 11 of the discharge vessel 12, also denoted gas container hereinafter. The electrons 4 lose no more than 10% of their energy when passing through the SiN window 10, the remainder is deposited, bounded strongly locally, in the gas space 11 which is filled with 200 mbar pure neon. A beam current amounts to approximately 0.1 mA. Each beam electron generates a plurality of secondary electrons and ions, i.e. approximately 500, in the gas space 11, and in addition a large number of highly excited states. Two planar electrodes 13 and 14 are provided outside the gas container 12, between which electrodes a radio-frequency AC field with a frequency of 13.6 MHz and an average voltage of 500 V is applied. The secondary electrons oscillate substantially in the radio-frequency AC field and support a discharge current, which is accordingly approximately 500 times higher than the beam current of an electron beam 15, i.e. approximately 50 mA. Approximately 25 W is accordingly capacitively coupled into the plasma, while the electron beam 15 introduces 2 W. The oscillating electrons adjust a uniform electron temperature by means of elastic collisions, which temperature hardly changes over a cycle because of the high frequency. The electron temperature of the secondary electrons is so low here, owing to the low ratio between electric AC field strength and neon pressure, that said secondary electrons do not contribute to the ionization, but only to an efficient excitation starting from the long-life excited neon states, and thus to the efficient light generation. Since the electron beam 15 introduces negative charge into the discharge vessel 12, this charge is to be drained off through a grounded wire 16 which is fused into the vessel 12.

A further embodiment of this system could be as follows: a cubic discharge vessel 12 with an edge length of 5 cm is filled with 500 mbar helium and 50 mbar neon. An electron beam 15 operates with 0.1 mA and 20 kV, which corresponds to a power of 2 W. Each primary electron 4 generates approximately 500 secondary electrons and secondary ions, i.e. the discharge current in the glow discharge is approximately 500 times the beam current, i.e. approximately 50 mA. The glow discharge has an average current of 50 mA and an average voltage of 500 V, which corresponds to a power of 25 W. At this very low ratio between electric field and gas pressure of 0.25 V/(cm Torr), there is hardly any ionization caused by the glow discharge; the glow discharge has a stable positive characteristic.

A third embodiment operates with 100 mbar argon and 5 mg mercury in the gas space 11, which has a volume of 3×3×3 $cm^3$. The discharge vessel 12 is heated so strongly in the stationary state that the mercury vapor pressure is approximately 1 mbar. Each beam electron generates mainly a plurality of more than 500 argon ions and secondary electrons in the gas space 11. Outside the vessel 12, two planar, transparent electrodes 13 and 14 of indium-tin oxide are provided, between which a radio-frequency AC field with a frequency of 27 MHz is applied. The secondary electrons oscillate substantially in the radio-frequency AC field and carry the discharge current, which is approximately 400 mA in this case. The average voltage across the discharge is approximately 50 V. Accordingly, approximately 20 W is coupled capacitively into the plasma, while the electron beam 15 contributes 2 W. The oscillating electrons adjust a homogeneous electron temperature by means of elastic collisions, which temperature hardly changes over a cycle because of the high frequency. The electron temperature of the secondary electrons is so low, because of the low ratio between electric field strength and argon pressure, that said electrons contribute not to the ionization, but to the excitation of the mercury and thus to the efficient generation of UV radiation at 254 nm. The conversion efficacy of the glow discharge power into UV radiation is 70%. A high brightness can be achieved because of small constructional dimensions. If visible light is desired, a phosphor may be provided on the inside of the discharge vessel for converting the UV radiation. The electron beam generates the charge carriers in the gas volume, keeps the glow discharge even, and leads to an immediate ignition of the discharge. The mercury may be replaced by an alternative light-generating gas whose vapor pressure is at least a few mTorr in the stationary state. Particularly interesting in this respect are, for example, sodium, strontium, and barium, because these atoms have strong lines in the visible wavelength range, and in addition especially molecular radiators such as indium bromide, whose resonant radiation lies in or close to the visible wavelength range.

FIG. 2 shows a second light source 20 with the electron beam source 2, the gas space 11, and a microwave resonator 21 which induces a glow discharge from the outside at a frequency of 2.45 GHz. The induced electric field is a rotational field; the electrons oscillate along circular path segments.

FIG. 3 shows a third light source 30 with the electron beam source 2, an electrode arrangement 31, and a discharge vessel 32. Electrodes 33 and 34 of the electrode arrangement 31 are formed as the cathode 33 and anode 34, respectively, which project into the discharge vessel 32. The cathode 33 comprises a tungsten coil 35, the anode 34 comprises a planar metal plate 36. Supply wires 37, 38, and 39 to the electrodes 33 and 34 are fused into the discharge vessel 32. A DC voltage of 500 V is applied between the cathode 33 and the anode 34. The cathode 33 is made to glow by an auxiliary heating current. The secondary electrons are the main carriers of the glow discharge current, which is accordingly approximately 500 times stronger than the beam current, i.e. approximately 50 mA. The secondary electrons drift towards the anode 34 in the electric field and thus adjust a very low electron temperature. Since the electron density should be approximately equal to the ion density in the discharge volume, while the electron current is much stronger than the ion current owing to the higher mobility of the electrons in the electric field, electrons must be additionally supplied from the cathode 33. This is achieved by the auxiliary heating of the cathode 33. An additional grounded wire is not necessary, because the function thereof is already performed by the anode 34.

LIST OF REFERENCE NUMERALS

1 light source
2 electron beam source
3 electron arrangement
4 electrons
5 cathode
6 hole
7 Wehnelt cylinder
8 acceleration range
9 ring anode
10 entry window
11 gas space
12 discharge vessel
13 electrode
14 electrode
15 electron beam
16 wire
20 light source
21 microwave resonator
30 light source
31 electrode arrangement
32 discharge vessel
33 cathode
34 anode
35 tungsten coil
36 planar metal plate
37 supply wire
38 supply wire
39 supply wire

The invention claimed is:

1. A light source comprising:

a discharge vessel which is filled with a filling gas, an electron beam source arranged in vacuum or in a region of low pressure, wherein said electron beam source is configured to generate and propel electrons through an inlet foil into the discharge vessel, a pair of electrodes located at sides of the discharge vessel adjacent to the inlet foil, wherein at least one of the electrode is a coil configured to generate an inductive AC field in the discharge vessel, and an electric field generator configured to generate an electric field inside the discharge vessel between the pair of electrodes.

2. The light source as claimed in claim 1, wherein the electrodes comprise a dielectric.

3. The light source as claimed in claim 1, wherein the discharge vessel comprises a microwave resonator configured to generate a rotational field to cause the electrons to rotate along circular paths.

4. The light source as claimed in claim 1, wherein the electron beam source comprises a field emitter.

5. The light source as claimed in claim 1, wherein the filling gas comprises at least one of the rare gases He, Ne, Ar, Kr, Xe.

6. The light source as claimed in claim 1, wherein the filling gas comprises at least one of the gases $H_2$, $N_2$, $O_2$, $F_2$, $Cl_2$.

7. The light source as claimed in claim 1, wherein the filling gas comprises at least one of the following elements which are wholly or partly evaporated under operational conditions: Br, I, S, Se, Te, Po, P, As, Sb, Zn, Cd, Hg, In, Tl, Li, Na, K, Rb, Cs, Sr, and Ba in atomic or molecular form.

8. The light source as claimed in claim 1, wherein the discharge vessel comprises a phosphor.

9. The light source as claimed in claim 1, wherein the discharge vessel comprises two diametrically opposed mirrors.

10. The light source of claim 1, wherein the electron beam source comprises an array having tips to facilitate freeing of the electrons.

11. The light source of claim 10, wherein the array includes at least one of nanotubes, pyramids and tentacles.

12. A light source comprising:

a discharge vessel filled with gas;

an electron beam source configured to generate and propel electrons through an inlet foil into the discharge vessel;

a pair of electrodes located at sides of the discharge vessel adjacent to the inlet foil, wherein at least one of the electrode is a coil configured to generate an inductive AC field in the discharge vessel; and an electric field generator configured to generate an electric field inside the discharge vessel between the pair of electrodes.

13. The light source of claim 12, wherein the electric field generator operates with an AC or a DC voltage.

14. The light source of claim 12, wherein the electric field includes a rotational field.

15. The light source of claim 12, wherein the electrons are configured to excite the gas into an excited state, and wherein the electric field is configured to further excite the excited state.

16. The light source of claim 12, wherein a field current supplied to the electric field generator is approximately five hundred times higher than a beam current supplied to the electron beam source.

17. The light source of claim 12, wherein a first energy supplied to the electron beam source is less than a second energy supplied to the electric field generator.

18. The light source of claim 12, wherein a ratio of the electric field and pressure of the gas is reduced so that secondary electrons generated in the discharge vessel contribute more to excitation that to ionization of the gas.

19. The light source of claim 12, wherein an electron current in the discharge vessel is higher than an ion current in the discharge vessel.

20. The light source of claim 12, wherein an electron density in the discharge vessel is approximately equal to an ion density in the discharge vessel.

21. The light source of claim 12, wherein the electron beam source comprises an array having tips to facilitate freeing of the electrons.

22. The light source of claim 21, wherein the array includes at least one of nanotubes, pyramids and tentacles.

* * * * *